United States Patent [19]

McNett et al.

[11] Patent Number: 4,995,844

[45] Date of Patent: Feb. 26, 1991

[54] BUBBLE BLOWING FIGURE TOY

[75] Inventors: John P. McNett, Farmington; Sal Mucaro, Burlington, both of Conn.

[73] Assignee: Tiger Electronics, Inc., Vernon Hills, Ill.

[21] Appl. No.: 444,515

[22] Filed: Dec. 1, 1989

[51] Int. Cl.[5] ..... A63H 33/28

[52] U.S. Cl. ..... 446/021; 446/15; 446/197

[58] Field of Search ..... 446/21, 15, 18, 16, 446/183, 184, 197, 198, 193

[56] References Cited

U.S. PATENT DOCUMENTS

| | | | |
|---|---|---|---|
| 612,121 | 10/1898 | Rakovsky | 446/21 |
| 1,124,204 | 1/1915 | Blair | 446/20 |
| 2,560,582 | 7/1951 | Limber | 446/18 |
| 2,853,829 | 9/1958 | Greene | 446/18 |
| 3,093,925 | 6/1963 | Greene | 446/18 |
| 3,473,253 | 10/1969 | Jakubowski et al. | 446/20 |
| 3,564,762 | 4/1971 | Crosman et al. | 446/19 X |
| 3,950,887 | 4/1976 | Kort | 446/15 |
| 4,299,049 | 11/1981 | Pimentel et al. | 446/15 |
| 4,804,346 | 2/1989 | Sheng | 446/17 |

FOREIGN PATENT DOCUMENTS

| | | | |
|---|---|---|---|
| 701054 | 12/1964 | Canada | 446/21 |
| 890155 | 9/1953 | Fed. Rep. of Germany | 446/16 |
| 644965 | 10/1950 | United Kingdom | 446/21 |

OTHER PUBLICATIONS

PCT 0281706, Sep. 1988, OHTA Class 446, Sub. 183.

*Primary Examiner*—Mickey Yu

*Attorney, Agent, or Firm*—Dressler, Goldsmith, Shore, Sutker & Milnamow, Ltd.

[57] ABSTRACT

A bubble blowing figure toy having a hollow torso configured with a head portion defining a mouth opening and a squeezable body portion. An operative device is arranged substantially within the torso of the figure toy for generating bubbles from a bubble forming liquid applied to the mouth opening. In response to squeezing of the figure toy, a stream of air is directed toward the mouth opening to facilitate bubble formation into either a large bubble or a series of generally uniform smaller bubbles. The operative device includes a mouthpiece, an air bladder, and an air duct. The mouthpiece is arranged at the mouth opening of the toy and to one end of which the bubble forming liquid is applied. The air bladder generates an air stream, and the air duct connects the air bladder with the mouthpiece. The air duct is configured to inhibit ingestion of bubble forming liquid into the air bladder. A valve in the air duct further facilitates bubble formation.

8 Claims, 2 Drawing Sheets

FIG. 3
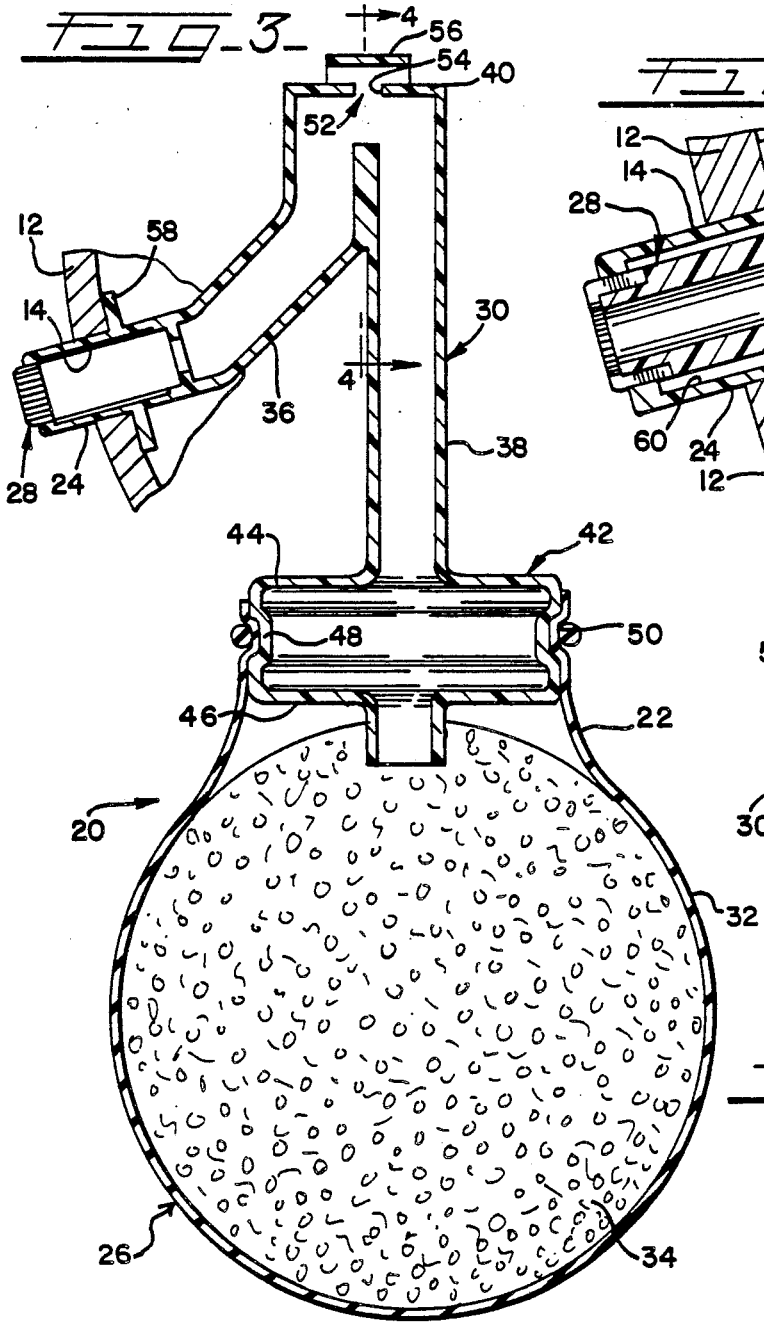
FIG. 5
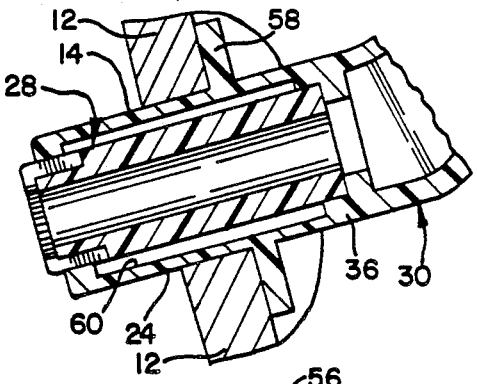
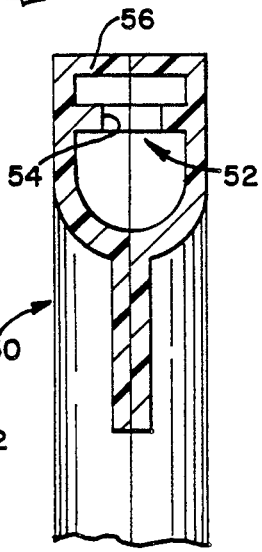
FIG. 4
FIG. 7
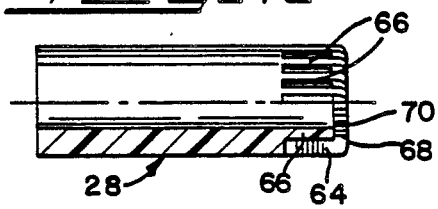
FIG. 6
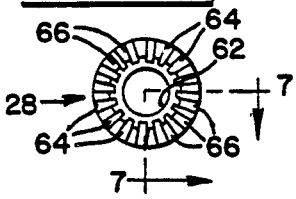

BUBBLE BLOWING FIGURE TOY

FIELD OF THE INVENTION

The present invention generally relates to toys and, more particularly, to a bubble blowing figure toy.

BACKGROUND OF THE INVENTION

Blowing bubbles from a bubble forming liquid or solution is a well known amusement particularly suited as a pastime of children. Accordingly, it has been suggested to provide toys which are capable of blowing one or more bubbles. These toys take many different forms and often represent a figure such as a person or a stuffed animal blowing the bubbles.

Many of such toys contain a reservoir from which liquid is drawn in response to blowing on a pipe or by manipulation of a pump handle or other suitable mechanism. Unless the toy is drained or properly oriented after use, however, the solution or liquid remaining in the reservoir may spill or leak from the toy. Children often sleep with their stuffed toys and thus proper orientation of the toy cannot always be readily accomplished. As will be appreciated, having a bubble solution leak or spill from a toy onto a bed, sofa, chair or the like can result in parental frustration as well as possible damage to furniture and to the toy.

On the other hand, if the bubble solution or liquid evaporates and dries within the toy, it may clog or interfere with a bubble forming passage detracting from the play potential of the toy. Subsequent cleaning may return the toy to an operative condition but usually requires parental intervention.

SUMMARY OF THE INVENTION

In view of the above, and in accordance with the present invention there is provided a bubble blowing figure toy which is operated by squeezing a soft body portion of the toy. The toy of the present invention includes an operative device arranged substantially within the soft body portion of the toy for generating bubbles from a bubble forming liquid which is applied to a mouth opening on the toy figure. The operative device directs a stream of air toward the mouth opening in response to squeezing of the figure toy and is configured to inhibit ingestion of the bubble blowing solution into the body portion of the toy figure. The operative device facilitates bubble formation into either a large bubble or series of uniformly sized smaller bubbles depending upon the volume and pressure of the air stream directed toward the mouth opening.

In the illustrated embodiment, the toy of the present invention has a hollow torso configured with a head portion defining the mouth opening and a body portion. Preferably, both the head portion and body portion are fabricated from a soft, squeezable material and are shaped in a form of a bear or a like figure which is recognizable to a child.

The operative device defines an air discharge end which opens to the mouth opening on the toy and an air supply end. In a preferred form, the operative device includes a mouthpiece arranged at the air discharge end and to which the bubble forming liquid is applied, an air bladder arranged at the air supply end for generating the stream of air in response to squeezing of the toy figure, and an air duct which connects the mouthpiece and the air bladder.

The mouthpiece defines an aperture across which a meniscus diaphragm of bubble forming liquid is produced as a result of the application of such liquid to the mouthpiece. At one end, the mouthpiece defines a series of through-holes. In the illustrated embodiment, a series of ribs are formed between the through-holes and extend radially outward from the aperture.

When the air stream is directed outwardly from the air discharge end of the operative device bubbles are formed from the meniscus diaphragm formed on the mouthpiece. The ribs on the mouthpiece are designed to entrap bubble forming liquid therebetween and inhibit liquid from leaking or spilling from the mouth opening in the toy. An annular ridge is formed between the inner ends of the ribs and the aperture in the mouthpiece to facilitate forming the meniscus diaphragm of bubble forming fluid. Additional bubble forming liquid is extracted from the through-holes in the mouthpiece by cohesion with the meniscus diaphragm to enhance the toy's ability to produce either a large bubble or a continuous stream of generally uniform bubbles emanating from the mouthpiece depending on the volume and pressure of the air pressure generated by collapsing the air bladder.

The air duct serves to direct the air stream between the air bladder and the mouthpiece. In a preferred form, the air duct has a generally U-shaped configuration including two leg portions which are joined by an elbow portion. The elbow portion of the air duct is normally arranged above open ends of the leg portions to inhibit ingestion of the bubble forming liquid into the air bladder. The elbow portion of the air duct defines an aperture which is sized to control pressure in the air stream flowing toward the mouthpiece and thereby facilitating bubble formation at the discharge end of the operative device.

In those embodiments where the operative device is arranged within a stuffed figure toy, a shield is preferably arranged relative to the aperture in the air duct to inhibit incursion of any foreign material into the air duct through the aperture. Preferably, the shield is formed as an integral part of the air duct. The air duct may further include a positioning ring located proximate to the air bladder of the present invention.

The operative device of the present invention allows the air bladder to be automatically returned from a collapsed condition to facilitate operation of the toy. In the illustrated embodiment, the air bladder includes a collapsible bulb which is sealed to the positioning ring provided on the air duct to retard the escape of air therebetween. A foam element, which is capable of self-recovery from a collapsed condition, is arranged within the bulb for automatically returning the air bladder from a collapsed condition.

The toy figure of the present invention is specifically designed with a minimum of parts which offer maximum reliability. The design of the present invention further provides suitable retention of bubble forming liquid to facilitate bubble making without incurring spillage and leakage of the bubble solution from the toy. The configuration of the operative device inhibits ingestion of bubble forming solution into the toy and thereby inhibits the solution from drying within the body portion or air duct leading to the mouthpiece. Moreover, the simple and direct operation of the toy enhances its play potential.

Numerous other features and advantages of the present invention will become apparent from the following detailed description, the accompanying drawings, and the appended claims.

BRIEF DESCRIPTION OF THE DRAWINGS

FIG. 3 is a longitudinal sectional view of the operative device illustrated in FIG. 2;

FIG. 4 is an enlarged sectional view taken along lines 4—4 of FIG. 3;

FIG. 5 is an enlarged sectional view of an air discharge end of the operative device illustrated in FIG. 3;

FIG. 6 is an end view of a mouthpiece forming part of the operative device; and

FIG. 7 is a sectional view taken along lines 7—7 of FIG. 6;

DETAILED DESCRIPTION OF THE PREFERRED EMBODIMENT

Figure 1:
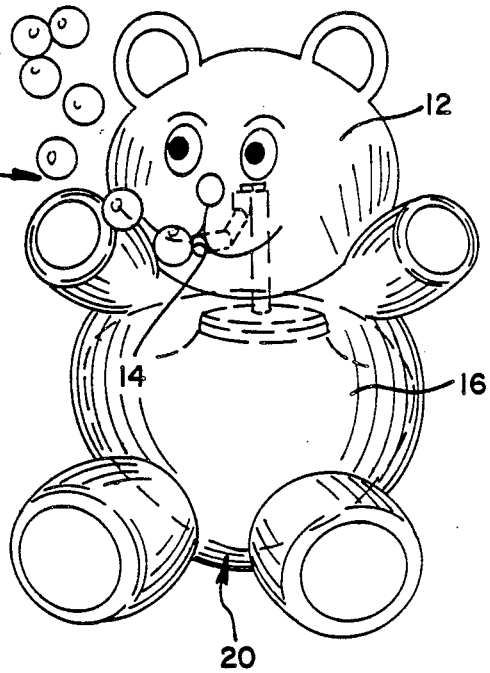
FIG. 1 is an elevational view of a figure toy embodying principles of the present invention.

While the present invention is susceptible of embodiment in many forms, there is shown in the drawings, and will hereinafter be described a preferred embodiment of the invention with the understanding that the present disclosure is to be considered as an exemplification of the invention and is not intended to limit the invention to the specific embodiment illustrated.

Referring now to the drawings, wherein like reference numerals indicate like parts throughout the several views, there is shown in FIGURE 1 a bubble blowing figure toy 10 preferably having an ornamental design one such being depicted as a stuffed bear which is readily recognizable by a young child. The figure toy 10 includes a head portion 12 defining a mouth opening 14 and a body portion 16. The head portion 12 and body portion 16 are connected to define a hollow torso or body. Arms and legs may also form part of the toy figure. At least the body portion 16 of the toy figure is flexible and is of substantial size to readily permit squeezing thereof.

Figure 2:
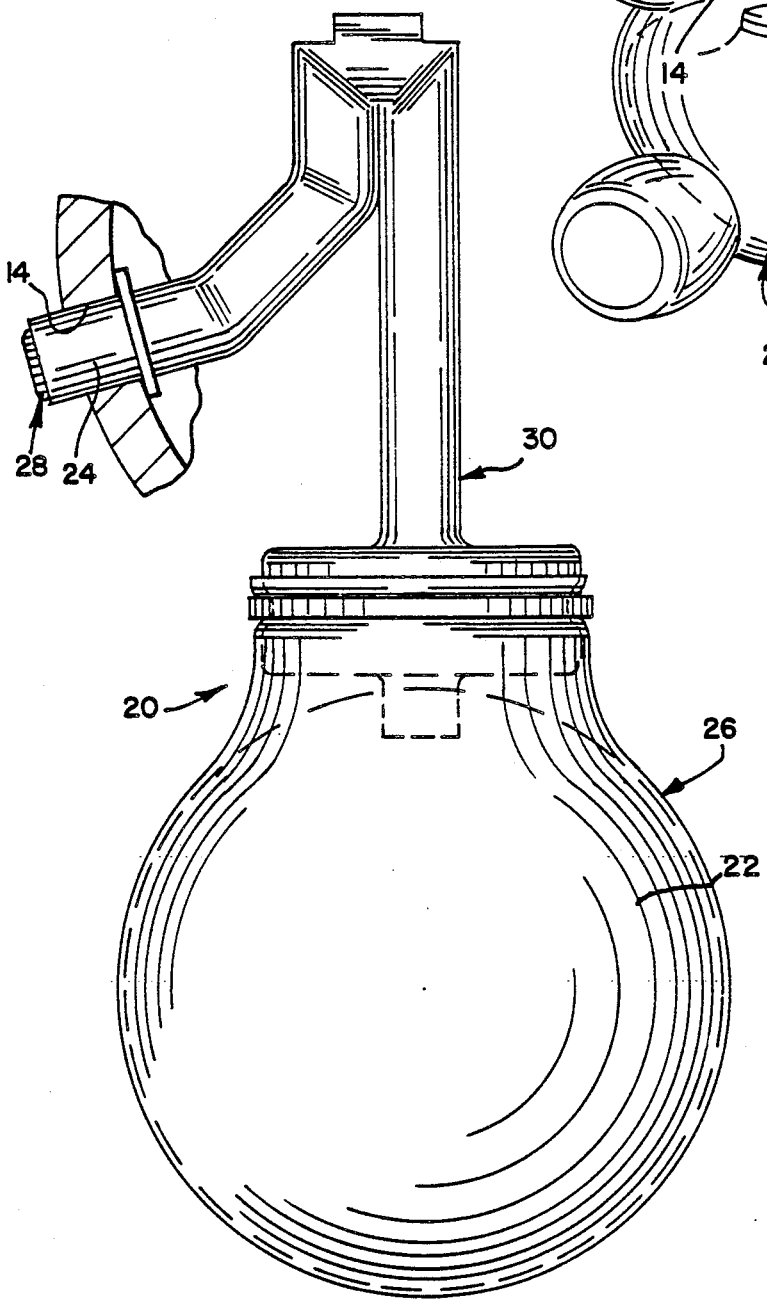
FIG. 2 is an elevational view of an operative device retained within the figure toy illustrated in FIG. 1.

The figure toy 10 further includes an operative device 20 arranged substantially within the hollow torso of the toy figure for generating bubbles from a bubble forming liquid. As illustrated in FIGURE 2, the operative device 20 defines an air supply end 22 and an air discharge end 24 which opens to the mouth opening 14. The operative device comprises a collapsible air bladder 26 arranged at the air supply end 22 of the operative device for generating a stream of air, a mouthpiece 28 arranged at the air discharge end 24 of the operative device and to which a bubble forming liquid is applied, and an air duct 30 connected at a first end to the air bladder 26 and at a second end to the mouthpiece 28.

As illustrated in FIG. 3, the air bladder 26 preferably includes a soft flexible bulb 32 having a sponge or foam element 34 arranged therewithin. The bulb 32 is preferably formed from a suitable plastic material which is generally impermeable to passage of air therethrough. The sponge or foam element 34 is capable of self recovery from a collapsed condition and is arranged within the bulb 32 for automatically returning the air bladder from a collapsed condition.

As illustrated in FIG. 3, the air duct 30 is provided to direct a stream of air generated by the air bladder 26 to the air discharge end 24 of the operative device 20. The elongated air duct 30 is fabricated from a suitable plastic material and has a generally U-shape or configuration. The air duct 30 includes hollow, open-ended leg portions 36 and 38 which are joined by a an elbow portion 40. As will be appreciated, when the figure toy 10 is in an upright position, the elbow portion 40 of the elongated air duct 30 is above the open ends of the leg portions 36 and 38. Accordingly, it will be understood that bubble forming liquid applied to the air discharge end 24 of the operative device 20 is inhibited from being ingested within the air bladder 26.

As illustrated in FIG. 3, the air duct 30 further includes a positioning ring 42 arranged on the leg portion 38 toward a lower end thereof. Preferably, the positioning ring 42 is formed as an integral part of the air duct 30 and includes upper and lower longitudinally spaced walls 44 and 46 which are joined by a circumferential wall 48. The upper and lower walls 46 and 48 flare outwardly from leg portion 38 of the air duct 30 and the circumferential wall 48 is configured with a recessed channel or groove 50 approximately mid-length thereof. The channel or groove 50 provided on the positioning ring facilitates sealing of the bulb 32 of the air bladder thereto to inhibit or retard the escape of air therebetween.

To control the pressure in the air stream flowing toward the air discharge end 24, the operative device further includes a valve 52. As illustrated, valve 52 is formed as an aperture 54 defined by the air duct 30 preferably at the upper end of the elbow portion 40 thereof. The aperture 54 is sized to control pressure in the air stream generated by the air bladder 26 and thereby facilitating bubble formation at the mouth opening 14 of the toy FIG. 10.

As mentioned above, the operative device 20 may be used in a stuffed toy figure. Accordingly, a shield 56 is arranged relative to the valve 52. As illustrated in FIG. 4, the shield 56 is preferably formed as an integral part of the air duct 30 and is adequately spaced from the aperture 54 to allow air to readily escape therefrom while concurrently inhibiting incursion of any foreign material into the air duct 30 through the aperture 54.

Turning now to FIG. 5, the mouthpiece 28 is arranged at the air discharge end 24 of the operative device 20. As illustrated in FIG. 5, the air duct 30 defines a radial flange portion 58 which promotes securement of the operative device to the hollow interior of the head portion 12 of the toy figure. Air duct 30 further defines a cavity 60 for accommodating the mouthpiece 28. As illustrated in FIG. 5, cavity 60 has a stepped configuration which supports the mouthpiece 28 at its ends and defines an annular recess surrounding and extending along the mouthpiece intermediate the ends thereof.

As illustrated in FIGS. 6 and 7, the mouthpiece 28 preferably has a tubular configuration defining a central aperture 62. The tubular configuration of the mouthpiece 28 facilitates its location and placement within the cavity 60 defined in the air duct 30. As illustrated in FIG. 7, mouthpiece 28 defines a series of through-holes 64 at a distal end thereof. A series of ribs 66 are defined between the through-holes 64 and radially extend outwardly from the central aperture 62.

As illustrated in FIG. 7, an annular ridge 68 is defined between an inner end of the ribs 66 and the central aperture 62 in the mouthpiece 28. The annular ridge 68 is concentric with the central aperture 62 and a concentric shoulder 70 defined by the ridge 68 aids in forming a meniscus diaphragm of bubble forming liquid across the central aperture 62 defined by the mouthpiece 28.

Application of a bubble forming liquid to the distal end of the mouthpiece 28 creates a meniscus diaphragm of bubble forming solution across the central aperture 62. Bubbles may be produced simply by squeezing the body portion 16 of the figure toy 10. Pressing on the body portion 10 of the toy causes the air bladder 26 to compress and thereby generate a stream of air. Such stream of air is directed to the mouthpiece 28 by the air duct 30. As the air is expelled through the mouthpiece 28, the meniscus diaphragm is formed into a bubble which floats away.

The through-holes 64 defined between the ribs 66 on the mouthpiece 28 hold additional bubble forming liquid which is used to enhance bubble formations and inhibit the bubble solution from leaking or spilling from the mouthpiece 28. The through-holes 64 open to the annular recess surrounding the mouthpiece and wherein additional bubble forming solution or liquid may be held. The additional bubble forming liquid is extracted from the through-holes 64 by cohesion with the meniscus diaphragm and thereby enhance the capacity of the meniscus diaphragm to produce either a large bubble or continuous stream of generally uniform bubbles emanating from the mouthpiece 28 depending upon the volume and pressure of the air stream generated by the collapsing air bladder 26. Moreover, the concentric shoulder 70 provided on the annular ring 68 at the distal end of the mouthpiece 28 aids in forming the meniscus diaphragm of bubble forming liquid across the aperture 62.

To further promote the creation of bubbles at the mouth opening 14 of the figure toy 10, the valve 52 in the air duct 30 regulates the pressure of the air stream directed outwardly from the mouthpiece 28. The shield 56 inhibits incursion of any foreign materials into the air duct through the aperture 54 defining the valve 52.

The air bladder 26 is permitted to quickly recover of its own accord after the squeezing pressure is released from the body portion of the figure toy. As mentioned above, the bulb 32 is made from an easily deformable plastic material and the foam element 34 which is capable of self-recovery from a collapsed condition, automatically returns the bulb and the air bladder from a collapsed condition. Because both the bulb 32 and foam element 34 are readily compressed, the bubble blowing operation is easily effected by children to enhance play.

Each time the body portion of the toy figure 10 is collapsed, a stream of air is directed toward the mouthpiece 28. After the body portion has been collapsed several times, another application of bubble forming solution is applied to the mouthpiece 28 to facilitate the creation of further bubbles. The U-shaped configuration of the air duct inhibits the ingestion of the bubble forming solution into the air bladder and maintains the figure toy in an operable condition. Because the liquid solution is generally maintained at the air discharge end of the operative device, it is easy to clean the mouthpiece 28 simply by providing a water solution to the mouthpiece in a manner cleaning same.

The generally soft outward appearance of the toy FIG. 10 makes it attractive and easily recognizable to children. The further ability of the toy figure 10 to generate bubbles further enhances its play potential. Although in the particular embodiment illustrated and described, the torso is made hollow with a flexible wall surrounding the operative device 20, it will appreciated that only part of the figure toy could be so formed, e.g. the body portion 14. Moreover, the figure toy 10 is advantageously assembled out of easily molded plastic parts to facilitate fabrication of the toy figure.

This invention has been described in terms of specific embodiments set forth in detail, but it should be understood that these are by way of illustration only and that the invention is not necessarily limited thereto. Modifications and variations will be apparent from the disclosure and may be resorted to without departing from the spirit of the invention, as those skilled in the art will readily understand. Accordingly, such variations and modifications of the disclosed products are considered to be within the purview and scope of the invention and the following claims.

What is claimed is:

1. A bubble blowing figure toy comprising:

a hollow torso configured with a head portion and a squeezable body portion, said head portion defining a mouth opening; and bubble blowing means arranged substantially within said hollow torso for generating bubbles from a bubble forming liquid, said bubble blowing means comprising collapsible air bladder means arranged within said hollow torso for generating a stream of air and defining an air supply end of said bubble blowing means, mouthpiece means positioned at the mouth opening of said torso and defining an air discharge end of said bubble blowing means, said mouthpiece means including an apertured mouthpiece defining a series of through-holes at a first end thereof and to which bubble forming fluid is applied, and elongated air duct means connected at a first end to said mouthpiece and at a second end to said air bladder means for directing a stream of air generated by said collapsible air bladder means toward and for positioning and holding said mouthpiece means at the mouth opening of said hollow torso such that it appears that bubbles are being blown from the mouth opening of the doll, said air duct means being configured between the ends thereof to inhibit ingestion of said bubble forming liquid into said air bladder means, and wherein application of said bubble forming liquid to the first end of said mouthpiece produces a meniscus diaphragm of bubble forming liquid across the aperture defined thereby with additional bubble forming liquid being extracted from said through holes by cohesion with the meniscus diaphragm thereby enhancing capacity of the meniscus diaphragm to produce either a large bubble or a continuous stream of generally uniform bubbles emanating from the mouthpiece depending upon volume and pressure of the air stream generated by collapsing said air bladder means.

2. A bubble blowing figure toy comprising:

a hollow torso configured with a head portion and a squeezable body portion, said head portion defining a mouth opening; and operative means arranged substantially within said hollow torso for generating bubbles from a bubble forming liquid, said operative means defining an air discharge end opening to the mouth opening and an air supply end, said operative means comprising an apertured mouthpiece arranged at the air discharge end of said operative means and to which said bubble forming liquid is applied, said mouthpiece defining a series of through-holes and a series of ribs defined between said through-holes at a first and of said mouthpiece, and wherein said ribs radially extend outwardly from the aperture defined by said mouthpiece which further defines an annular ridge formed between an inner end of said ribs and the aperture in said mouthpiece to facilitate forming a meniscus diaphragm of bubble forming liquid across the aperture defined by said mouthpiece, collapsible air bladder means arranged within said hollow torso at the air supply end of said operative means for generating a stream of air, and an elongated air duct connected at a first end to said mouthpiece and at a second end to said air bladder means to direct said stream of air toward said mouthpiece, said air duct being configured between the ends thereof to inhibit ingestion of said bubble forming liquid into said air bladder means, and wherein application of said bubble forming liquid to the first end of said mouthpiece produces the meniscus diaphragm o f bubble forming liquid across the aperture defined thereby with additional bubble forming liquid being extracted from said through holes by cohesion with the meniscus diaphragm and thereby enhancing the capacity of the meniscus diaphragm to produce either a large bubble or a continuous stream of generally uniform bubbles emanating from the mouthpiece depending upon volume and pressure of the air stream generated by collapsing said air bladder means.

3. A bubble blowing figure toy comprising:

a hollow torso configured with a head portion and a squeezable body portion, said head portion defining a mouth opening; and operative means arranged substantially within said hollow torso for generating bubbles from a bubble forming liquid, said operative means defining an air discharge end opening to the mouth opening and an air supply end, said operative means comprising an apertured mouthpiece arranged at the air discharge end of said operative means and to which said bubble forming liquid is applied, said mouthpiece defining a series of through-holes at a first end thereof, collapsible air bladder means arranged within said hollow torso at the air supply end of said operative means for generating a stream of air and an elongated air duct connected at a first end to said mouthpiece and at a second end to said air bladder means to direct said stream of air toward said mouthpiece, said air duct having between its ends a generally U-shaped configuration including two leg portions which are joined by an elbow portion, and wherein the elbow portion is normally arranged above open ends of said leg portions to inhibit ingestion of said bubble forming liquid into said air bladder means and defines an aperture which is sized to control pressure in the air stream flowing toward said mouthpiece thereby facilitating bubble formation at the air discharge end of said operative means, and wherein application of said bubble forming liquid to the first end of said mouthpiece produces a meniscus diaphragm of bubble forming liquid across the aperture defined by said mouthpiece with additional bubble forming liquid being extracted from said through holes by cohesion with the meniscus diaphragm and thereby enhancing the capacity of the meniscus diaphragm to produce either a large bubble or a continuous stream of generally uniform bubbles emanating from the mouthpiece depending upon volume and pressure of the air stream generated by collapsing said air bladder means.

4. The bubble blowing figure according to claim 3, wherein a shield is arranged relative to the aperture in the elbow portion of said air duct to inhibit incursion of any foreign materials into the air duct through said aperture.

5. The bubble blow figure toy according to claim 4 wherein said shield is integrally formed as part of said air duct to facilitate fabrication thereof.

6. The bubble blowing figure toy according to claim 3 wherein said operative means further includes means for automatically returning said air bladder means from a collapsed condition.

7. The bubble blowing figure toy according to claim 3 wherein said air bladder means includes a collapsible bulb which is sealed to the second end of said air duct to retard the escape of air therebetween, and a foam element which is capable of self recovery from a collapsed condition arranged within said bulb for automatically returning the air bladder means from a collapsed condition.

8. The bubble blowing figure toy according to claim 7 wherein said duct means defines a positioning ring located proximate to the second end of said duct and about which said rubber bulb is secured.

* * * * *